US009101949B2

(12) United States Patent
Babaev

(10) Patent No.: US 9,101,949 B2
(45) Date of Patent: Aug. 11, 2015

(54) ULTRASONIC ATOMIZATION AND/OR SEPERATION SYSTEM

(76) Inventor: Eilaz Babaev, Minnetonka, MN (US)

( * ) Notice: Subject to any disclaimer, the term of this patent is extended or adjusted under 35 U.S.C. 154(b) by 1560 days.

(21) Appl. No.: 11/610,402

(22) Filed: Dec. 13, 2006

(65) Prior Publication Data

US 2008/0054091 A1 Mar. 6, 2008

Related U.S. Application Data

(63) Continuation-in-part of application No. 11/197,915, filed on Aug. 4, 2005, now abandoned.

(51) Int. Cl.

| | |
|---|---|
| ***B05B 1/08*** | (2006.01) |
| ***B05B 17/06*** | (2006.01) |
| ***B01F 3/08*** | (2006.01) |
| ***B01F 11/02*** | (2006.01) |
| *B05B 13/04* | (2006.01) |

(52) U.S. Cl.

CPC ..... *B05B 17/0623* (2013.01); *B01F 3/08* (2013.01); *B01F 11/0258* (2013.01); *B05B 17/0676* (2013.01); *B05B 13/0442* (2013.01)

(58) Field of Classification Search

CPC ... B01F 11/0258; B01F 3/08; B05B 17/0676; B05B 17/0623; B05B 13/0442

USPC ..... 239/102.1, 102.2; 604/22

See application file for complete search history.

(56) References Cited

U.S. PATENT DOCUMENTS

| | | | |
|---|---|---|---|
| 3,523,906 | A | 8/1970 | Vrancken et al. |
| 3,561,444 | A | 2/1971 | Boucher et al. |
| 3,663,288 | A | 5/1972 | Miller et al. |
| 3,779,792 | A | 12/1973 | Stoy et al. |
| 3,970,250 | A | 7/1976 | Drews |
| 4,047,957 | A | 9/1977 | De Winter et al. |
| 4,100,309 | A | 7/1978 | Micklus et al. |
| 4,119,094 | A | 10/1978 | Micklus et al. |
| 4,263,188 | A | 4/1981 | Hampton et al. |
| 4,271,705 | A | 6/1981 | Crostack |
| 4,301,093 | A | 11/1981 | Eck |
| 4,306,998 | A | 12/1981 | Wenzel et al. |
| 4,309,989 | A | 1/1982 | Fahim |
| 4,319,155 | A | 3/1982 | Nakai et al. |
| 4,373,009 | A | 2/1983 | Winn |
| 4,387,024 | A | 6/1983 | Kurihara et al. |
| 4,389,330 | A | 6/1983 | Tice et al. |
| 4,391,797 | A | 7/1983 | Folkmam et al. |
| 4,402,458 | A | 9/1983 | Lierke et al. |
| 4,459,317 | A | 7/1984 | Lambert |
| 4,487,808 | A | 12/1984 | Lambert |
| 4,492,622 | A | 1/1985 | Kuypers |
| 4,536,179 | A | 8/1985 | Anderson et al. |
| 4,548,844 | A | 10/1985 | Podell et al. |
| 4,582,654 | A | 4/1986 | Karnicky et al. |
| 4,642,267 | A | 2/1987 | Creasy et al. |
| 4,666,437 | A | 5/1987 | Lambert |

(Continued)

*Primary Examiner* — Jason Boeckmann

(57) ABSTRACT

The present invention relates to an ultrasound liquid atomization and/or separation system including an ultrasound atomizer and a liquid storage area in communication with the ultrasound atomizer. The ultrasound atomizer has an ultrasound transducer, an ultrasound tip at the distal end of the transducer, a liquid delivery orifice or plurality of liquid delivery orifices, and a radiation surface at the distal end of the tip. The atomizer may include a liquid delivery collar having a liquid receiving orifice and a liquid delivery orifice. The liquid delivery collar may also include a central orifice into which the ultrasound tip may be inserted.

10 Claims, 8 Drawing Sheets

(56) References Cited

U.S. PATENT DOCUMENTS 4,675,361 A 6/1987 Ward, Jr.
4,684,328 A 8/1987 Murphy
4,692,352 A 9/1987 Huddleston
4,705,709 A 11/1987 Vailancourt
4,715,353 A 12/1987 Koike et al.
4,721,117 A 1/1988 Mar et al.
4,726,524 A * 2/1988 Ishikawa et al. ..... 239/102.2
4,726,525 A 2/1988 Yonekawa et al.
4,734,092 A 3/1988 Millerd
4,748,986 A 6/1988 Morrison et al.
4,768,507 A 9/1988 Fischell et al.
4,770,664 A 9/1988 Gogolewski
4,793,339 A 12/1988 Matsumoto et al.
4,795,458 A 1/1989 Regan
4,833,014 A 5/1989 Linder et al.
4,841,976 A 6/1989 Packard et al.
4,844,343 A * 7/1989 Kurokawa et al. ..... 239/102.2
4,850,534 A 7/1989 Takahashi et al.
4,867,173 A 9/1989 Leoni et al.
4,876,126 A 10/1989 Takemura et al.
4,877,989 A 10/1989 Drews et al.
4,884,579 A 12/1989 Engelson
4,923,464 A 5/1990 Di Pisa, Jr.
4,925,698 A 5/1990 Klausner et al.
4,943,460 A 7/1990 Markle et al.
4,959,074 A 9/1990 Halpern et al.
4,964,409 A 10/1990 Tremulis
4,969,890 A 11/1990 Sugita et al.
4,980,231 A 12/1990 Baker et al.
5,002,582 A 3/1991 Guire et al.
5,007,928 A 4/1991 Okamura et al.
5,008,363 A 4/1991 Mallon et al.
5,017,383 A 5/1991 Ozawa et al.
5,019,400 A 5/1991 Gombtz et al.
5,026,607 A 6/1991 Kiezulas
5,037,656 A 8/1991 Pitt et al.
5,037,677 A 8/1991 Halpern et al.
5,040,543 A 8/1991 Badera et al.
5,049,403 A 9/1991 Larm et al.
5,057,371 A 10/1991 Cantry et al.
5,066,705 A 11/1991 Wickert
5,067,489 A 11/1991 Lind
5,069,217 A 12/1991 Fleischhacker, Jr.
5,069,226 A 12/1991 Yamauchi et al.
5,076,266 A * 12/1991 Babaev ..... 128/200.16
5,079,093 A 1/1992 Akashi et al.
5,080,683 A 1/1992 Sulc et al.
5,080,924 A 1/1992 Kamel et al.
5,084,315 A 1/1992 Karimi et al.
5,091,205 A 2/1992 Fan
5,100,669 A 3/1992 Hyon et al.
5,102,401 A 4/1992 Lambert et al.
5,102,402 A 4/1992 Dror et al.
5,102,417 A 4/1992 Palmaz
5,105,010 A 4/1992 Sundaearaman et al.
5,107,852 A 4/1992 Davidson et al.
5,119,775 A 6/1992 Kokubo et al.
5,128,170 A 7/1992 Matsuda et al.
5,134,993 A 8/1992 Van der Linden et al.
5,147,370 A 9/1992 McNamara et al.
5,160,790 A 11/1992 Elton
5,179,923 A 1/1993 Tsurutani et al.
5,211,183 A 5/1993 Wilson
5,213,111 A 5/1993 Cook et al.
5,217,026 A 6/1993 Stoy et al.
5,234,457 A 8/1993 Andersen
5,240,994 A 8/1993 Brink et al.
5,241,970 A 9/1993 Johlin, Jr. et al.
5,243,996 A 9/1993 Hall
5,250,613 A 10/1993 Bergstrom
5,266,359 A 11/1993 Spievogel
5,275,173 A 1/1994 Samson et al.
5,282,823 A 2/1994 Schwartz et al.
5,283,063 A 2/1994 Freeman
5,290,585 A 3/1994 Elton
5,304,121 A 4/1994 Sahatjian
5,304,140 A 4/1994 Kugo et al.
5,315,998 A 5/1994 Tachibana et al.
5,336,534 A 8/1994 Nakajima et al.
5,344,426 A 9/1994 Lau et al.
5,370,614 A 12/1994 Amundson et al.
5,380,299 A 1/1995 Fearnot et al.
5,389,379 A 2/1995 Dirix et al.
5,409,163 A 4/1995 Erickson et al.
5,419,760 A 5/1995 Narciso, Jr.
5,423,885 A 6/1995 Williams
5,443,458 A 8/1995 Eury
5,443,496 A 8/1995 Schwartz et al.
5,447,724 A 9/1995 Helmus et al.
5,449,372 A 9/1995 Schmaltz et al.
5,449,382 A 9/1995 Dayton
5,464,650 A 11/1995 Berg et al.
5,470,829 A 11/1995 Prisell et al.
5,476,909 A 12/1995 Kim et al.
5,512,055 A 4/1996 Domb et al.
5,514,154 A 5/1996 Lau et al.
5,515,841 A 5/1996 Robertson et al.
5,515,842 A 5/1996 Ramseyer et al.
5,527,337 A 6/1996 Stack et al.
5,540,384 A 7/1996 Erickson et al.
5,545,208 A 8/1996 Wolff et al.
5,548,035 A 8/1996 Kim et al.
5,551,416 A 9/1996 Simpson et al.
5,562,922 A 10/1996 Lambert
5,569,463 A 10/1996 Helmus et al.
5,576,072 A 11/1996 Hostettler et al.
5,578,075 A 11/1996 Dayton
5,582,348 A 12/1996 Erickson et al.
5,591,227 A 1/1997 Dinh et al.
5,597,292 A 1/1997 Rhee et al.
5,605,696 A 2/1997 Eury et al.
5,609,629 A 3/1997 Fearnot et al.
5,616,608 A 4/1997 Kinsella et al.
5,620,738 A 4/1997 Fan et al.
5,624,411 A 4/1997 Tuch
5,626,862 A 5/1997 Brem et al.
5,637,113 A 6/1997 Tartaglia et al.
5,656,036 A 8/1997 Palmaz
5,674,192 A 10/1997 Sahatjian et al.
5,674,241 A 10/1997 Bley et al.
5,674,242 A 10/1997 Phan et al.
5,679,400 A 10/1997 Tuch
5,697,967 A 12/1997 Dinh et al.
5,700,286 A 12/1997 Tartaglia et al.
5,702,754 A 12/1997 Zhong
5,709,874 A 1/1998 Hanson et al.
5,712,326 A 1/1998 Jones et al.
5,716,981 A 2/1998 Hunter et al.
5,733,925 A 3/1998 Kunz et al.
5,739,237 A 4/1998 Russel et al.
5,755,769 A 5/1998 Richard et al.
5,776,184 A 7/1998 Tuch
5,785,972 A 7/1998 Tyler
5,799,732 A 9/1998 Gonzalez et al.
5,803,106 A 9/1998 Cohen et al.
5,837,008 A 11/1998 Berg et al.
5,868,153 A 2/1999 Cohen et al.
5,902,332 A 5/1999 Schatz et al.
5,922,247 A 7/1999 Shoham et al.
5,957,975 A 9/1999 Lafont et al.
5,970,974 A 10/1999 Van Der Linden et al.
5,972,027 A 10/1999 Johnson
5,996,903 A 12/1999 Asai et al.
6,041,253 A 3/2000 Kost et al.
6,053,424 A 4/2000 Gipson et al.
6,077,543 A 6/2000 Gordon et al.
6,099,561 A 8/2000 Alt
6,099,562 A 8/2000 Ding et al.
6,099,563 A 8/2000 Zhong
6,102,298 A 8/2000 Bush
6,104,952 A 8/2000 Tu et al.
6,120,536 A 9/2000 Ding et al.
6,155,540 A 12/2000 Takamatsu et al.
6,161,536 A 12/2000 Redmon et al.

(56) References Cited

U.S. PATENT DOCUMENTS

| | | | |
|---|---|---|---|
| 6,190,315 | B1 | 2/2001 | Kost et al. |
| 6,231,600 | B1 | 5/2001 | Zhong |
| 6,234,765 | B1 | 5/2001 | Deak |
| 6,234,990 | B1 | 5/2001 | Rowe et al. |
| 6,237,525 | B1 | 5/2001 | Kinnunen |
| 6,247,525 | B1 | 6/2001 | Smith et al. |
| 6,251,099 | B1 | 6/2001 | Kollias et al. |
| 6,258,121 | B1 | 7/2001 | Yang et al. |
| 6,287,285 | B1 | 9/2001 | Michael et al. |
| 6,296,630 | B1 | 10/2001 | Altman et al. |
| 6,299,604 | B1 | 10/2001 | Ragheb et al. |
| 6,306,166 | B1 | 10/2001 | Barry et al. |
| 6,335,029 | B1 | 1/2002 | Kamath et al. |
| 6,369,039 | B1 | 4/2002 | Palasis et al. |
| 6,402,046 | B1 | 6/2002 | Loser |
| 6,478,754 | B1 | 11/2002 | Babaev |
| 6,530,370 | B1 | 3/2003 | Heinonen |
| 6,543,700 | B2 | 4/2003 | Jameson et al. |
| 6,569,099 | B1 | 5/2003 | Babaev |
| 6,601,581 | B1 | 8/2003 | Babaev |
| 6,663,554 | B2 | 12/2003 | Babaev |
| 6,706,288 | B2 | 3/2004 | Gustavsson et al. |
| 6,706,337 | B2 | 3/2004 | Hebert |
| 6,720,710 | B1 | 4/2004 | Wenzel et al. |
| 6,730,349 | B2 | 5/2004 | Schwartz et al. |
| 6,739,520 | B2 | 5/2004 | Ohinishi et al. |
| 6,761,729 | B2 | 7/2004 | Babaev |
| 6,811,805 | B2 | 11/2004 | Gilliard et al. |
| 6,837,445 | B1 | 1/2005 | Tsai |
| 6,845,759 | B2 | 1/2005 | Ohnishi et al. |
| 6,861,088 | B2 | 3/2005 | Weber et al. |
| 6,883,729 | B2 | 4/2005 | Putvinski et al. |
| 7,017,282 | B2 | 3/2006 | Pyo et al. |
| 7,060,319 | B2 | 6/2006 | Fredrickson |
| 7,077,860 | B2 | 7/2006 | Yan et al. |
| 7,086,617 | B2 | 8/2006 | Fukumoto et al. |
| 2002/0127346 | A1 | 9/2002 | Heber |
| 2003/0098364 | A1 | 5/2003 | Jameson |
| 2003/0223886 | A1 | 12/2003 | Keilman |
| 2004/0039375 | A1 | 2/2004 | Miyazawa |
| 2004/0045547 | A1 | 3/2004 | Yamamoto et al. |
| 2004/0191405 | A1 | 9/2004 | Kerrigan |
| 2004/0197585 | A1 | 10/2004 | Hughes et al. |
| 2004/0204680 | A1 | 10/2004 | Lal et al. |
| 2004/0204750 | A1 | 10/2004 | Dinh |
| 2004/0211362 | A1 | 10/2004 | Castro et al. |
| 2004/0215313 | A1 | 10/2004 | Cheng |
| 2004/0215336 | A1 | 10/2004 | Udipi et al. |
| 2004/0220610 | A1 | 11/2004 | Kreidler et al. |
| 2004/0224001 | A1 | 11/2004 | Pacetti et al. |
| 2004/0234748 | A1 | 11/2004 | Stenzel |
| 2004/0236399 | A1 | 11/2004 | Sundar |
| 2004/0249449 | A1 | 12/2004 | Shanley et al. |
| 2005/0043788 | A1 | 2/2005 | Luo et al. |
| 2005/0058768 | A1 | 3/2005 | Teichman |
| 2005/0064088 | A1 | 3/2005 | Fredrickson |
| 2005/0070936 | A1 | 3/2005 | Pacetti |
| 2005/0070997 | A1 | 3/2005 | Thornton et al. |
| 2007/0295832 | A1 | 12/2007 | Gibson et al. |
| 2008/0006714 | A1 | 1/2008 | McNichols et al. |

* cited by examiner

ULTRASONIC ATOMIZATION AND/OR SEPERATION SYSTEM

CROSS REFERENCE TO RELATED APPLICATIONS

This application is a continuation-in-part of non-provisional U.S. application Ser. No. 11/197,915, filed Aug. 4, 2005 now abandoned, the teachings of which are hereby incorporated by reference.

BACKGROUND OF THE INVENTION

The present invention relates to an ultrasound liquid atomization system capable of atomizing liquids, mixing liquids, and/or separating liquids from gases, liquids, solids, or any combination thereof suspended and/or dissolved within a liquid.

Liquid atomization is the process by which a quantity of liquid is broken apart into small droplets, also referred to as particles. Liquid atomizers have been utilized in a variety of applications. For instance, liquid atomizers have been utilized to apply various coatings to devices. Gasoline is injected into most modern engines by use of a liquid atomizer, often referred to as a fuel injector. Delivering therapeutic substances to the body as to treat asthma or wounds is often accomplished through the use of liquid atomizers.

Traditional liquid atomizers, such as those generally employed as fuel injectors, utilize pressure to disperse a liquid into smaller droplets. These injectors function by forcing a pressurized liquid through small orifices opening into a larger area. As the liquid passes from the small orifice into the larger area, the atomized liquid-increases in volume.

Conceptually, this is similar to the inflation of a balloon and can be represented by the equation:

$$\text{Volume} = \frac{(\text{A constant, } k) \times (\text{Area outside the orifice})}{(\text{Force pushing the liquid through the orifice})}$$

According to the above equation, as the area into which a liquid is forced gets larger the volume of the liquid begins to increase. Thus as the liquid initially exits from the small orifice of a typical fuel injector, the liquid forms an expanding drop very similar to an inflating balloon. The liquid exiting from the injector is initially retained in the drop by the surface tension of the liquid on the surface of the drop, which is conceptually similar to the elastic of a balloon. Surface tension is created by the attraction between the molecules of the liquid located at the surface of the drop. As the volume of the liquid increases, the drop at the injector's orifice begins to expand. Expansion of the drop moves the molecules at the surface of the drop farther away from each other. Eventually, the molecules on the surface of the drop move far enough away from each other as to break the attractive forces holding the molecules together. When the attractive forces between the molecules are broken, the drop explodes like an over inflated balloon. Explosion of the drop releases several smaller droplets, thereby producing an atomized spray.

Atomized sprays can also be generated through the use of ultrasonic devices. These devices atomize liquids by exposing the liquid to be atomized to ultrasound, as to create ultrasonic vibrations within the liquid. The vibrations within the liquid cause molecules on the surface of the liquid to move about, disrupting the surface tension of the liquid. Disruption of the liquid's surface tension creates areas on the surface of the liquid with reduced or no surface tension, which are very similar to holes in a sieve, through which droplets of the liquid can escape. Devices utilizing this phenomenon to create a fog or mist are described in U.S. Pat. No. 7,017,282, U.S. Pat. No. 6,402,046, U.S. Pat. No. 6,237,525, and U.S. Pat. No. 5,922,247.

Disrupting the surface tension of a liquid with ultrasonic vibrations can also be utilized to expel a liquid through small orifices through which the liquid would not otherwise flow. In such devices the surface tension of the liquid holds the liquid back, like a dam, preventing it from flowing through the small channels. Exposing the liquid to ultrasound causes the liquid's molecules to vibrate, thereby disrupting the surface tension dam and allowing the liquid to flow through the orifice. This phenomenon is employed in inkjet print cartilages and the devices described in U.S. Pat. No. 7,086,617, U.S. Pat. No. 6,811,805, U.S. Pat. No. 6,845,759, U.S. Pat. No. 6,739,520, U.S. Pat. No. 6,530,370, and U.S. Pat. No. 5,996,903.

Ultrasonic vibrations have also been utilized to enhance liquid atomization in pressure atomizers such as fuel injectors. Again, the introduction of ultrasonic vibrations disrupts or weakens the surface tension holding the liquid together, making the liquid easier to atomize. Thus, exposing the liquid to ultrasonic vibrations as the liquid exits a pressure atomizer reduces the amount of pressure needed to atomize the liquid and/or allows for the use of a larger orifice. Injection devices utilizing ultrasound in this manner are described in U.S. Pat. No. 6,543,700, U.S. Pat. No. 6,053,424, U.S. Pat. No. 5,868,153, and U.S. Pat. No. 5,803,106.

Atomizers relying on pressure, in whole or in part, to atomize liquids are sensitive to pressure changes in the environment into which the atomized liquid is to be injected. If the pressure of the environment increases, the effective pressure driving liquid atomization decreases. The decrease in the effective pressure driving and/or assisting liquid atomization occurs because the pressure within the environment pushes against the liquid as the liquid exits the atomizer, thereby hindering atomization and expulsion from the atomizer. Conversely, if the pressure of the environment into which the atomized liquid Is injected decreases, the effective pressure driving and/or assisting liquid atomization increases.

Ultrasonic waves traveling through a solid member, such as a rod, can also be utilized to atomize a liquid and propel the atomized liquid away from the member. Such devices function by dripping or otherwise placing the liquid to be atomized on the rod as ultrasonic waves travel through the rod. Clinging to the rod, the liquid is transported to the end of the rod by the ultrasonic vibrations within the rod. An everyday example of this phenomenon is a person attempting to pour water from a glass by holding the glass at a slight angle. Instead of the water pouring put of the glass and dropping straight down to the floor, the water clings to and runs along the external sides of the glass before falling from the glass to the floor. Similarly, the liquid to be atomized clings to the sides of an ultrasonically vibrating rod as the liquid is carried towards the end of the rod by ultrasonic waves traveling through the rod. Ultrasonic wave emanating from the tip of rod atomize and propel the liquid forward, away from the tip. Devices utilizing ultrasonic waves to atomize liquids in such a manner are described in U.S. Pat. No. 6,761,729, U.S. Pat. No. 6,706,337, U.S. Pat. No. 8,663,554, U.S. Pat. No. 8,589,099, U.S. Pat. No. 6,247,525, U.S. Pat. No. 5,970,974, U.S. Pat. No. 5,179,923, U.S. Pat. No. 5,119,775, and U.S. Pat. No. 5,076,268.

In such devices, care must be utilized when delivering the liquid to the vibrating rod. For instance, if the liquid is dropped from to high of a point a majority of the liquid will bounce off the rod. The devices depicted in U.S. Pat. No. 5,582,348, U.S. Pat. No. 5,540,384, and U.S. Pat. No. 5,409,163 utilize a meniscus to gently deliver liquid to a vibrating rod. The meniscus holds the liquid to be atomized between the vibrating rod and the point of delivery by the attraction of the liquid to the rod and the point of delivery. As described in U.S. Pat. No. 5,540,384 to Erickson at al., creation of a meniscus requires careful construction and design of the liquid delivery point. Furthermore, if the delivery pressure of the liquid changes, the meniscus may be lost. For instance, if the delivery pressure suddenly increases, the liquid may become atomized before a meniscus can be formed. Destruction of the meniscus may also occur if the pressure outside the liquid delivery point suddenly changes. Thus, use of a meniscus to deliver a liquid to be atomized to a vibrating rod is generally limited to situations where the construction of the device, the design of the device, and the environment in which the device is used can be carefully monitored and controlled.

According there is a need for a liquid atomization system that enables the production and release of a consistent spray of an atomized liquid into an environment, despite changes in the pressure of the environment into which the atomized spray is injected.

SUMMARY OF THE INVENTION

The present invention relates to an ultrasound liquid atomization and/or separation system comprising an ultrasound atomizer and a liquid storage area in communication with said ultrasound atomizer. The system may further comprise an injector containing an injector body housing the ultrasound atomizer and a channel or plurality of channels running through said injector body and delivering liquids to said ultrasound atomizer. The ultrasound atomizer comprises an ultrasound transducer, an ultrasound tip at the distal end of said transducer, a liquid delivery orifice or plurality of liquid delivery orifices, and a radiation surface at the distal end of said tip. The atomizer may further comprise a liquid delivery collar comprising a liquid receiving orifice or a plurality of liquid receiving orifices and a liquid delivery orifice or plurality of liquid delivery orifices. The liquid delivery collar may further comprise a central orifice into which said ultrasound tip may be inserted. Electing and atomizing liquid in a pressure independent manner, the liquid atomization and/or separation system of the present invention enables the production and release of a consistent spray of liquid into an environment despite changes in pressure within the environment. Mixing liquids during injection and atomization, the system of the present invention also enables the production of hybrid liquid sprays. Atomizing liquids containing dissolved and/or suspended gasses liquids, solids, or any combination thereof, the present invention enables the separation of liquids from gasses, liquids, solids, or any combination thereof suspended and/or dissolved within said liquid.

The delivery collar of the ultrasound atomizer receives and expels a pressurized liquid. As the pressurized liquid leaves the narrow delivery orifice of the delivery collar it enters the larger area of the space between the collar and the ultrasound tip, thereby causing the volume of the liquid to expand like a balloon. Before the volume of the liquid becomes large enough to break the surface tension of the liquid causing the liquid to atomize, the liquid comes in contact with the ultrasound tip. Utilizing a phenomenon similar to capillary action, the ultrasound tip, when driven by the ultrasound transducer, pulls the liquid towards the radiation surface of the ultrasound tip. An everyday example of this phenomenon is a person attempting to pour water from a glass by holding the glass at a slight angle. Instead of the water pouring out of the glass and dropping straight down to the floor, the water clings to and runs along the external sides of the glass before falling from the glass to the floor. Similarly, the liquid to be atomized clings to the sides of the ultrasound tip as the liquid is carried towards the radiation surface by the ultrasonic waves traveling through the tip. Ultrasonic waves emanating from the radiation surface atomize and propel the liquid forward, away from the tip.

Carrying liquid away from the point at which the expanding drop of liquid contacts the ultrasound tip prevents further expansion of the drop, similar to a leak in a balloon. Mathematically, this effect can be represented by the following equation:

$$\text{Volume} = \frac{(\text{number molecules of the liquid present}) \times (\text{area}) \times (\text{a constant})}{(\text{force acting of the liquid})}$$

Thus, as the number of molecules within the expanding drop of liquid decreases the volume of the drop decreases, or at least stops expanding. Carrying liquid out of the drop and towards the radiation surface, the ultrasonic waves passing through the ultrasound tip decrease the number of the molecules within the drop. If the drop formed from the liquid released from the delivery orifice of the delivery collar stops expanding before the volume of the drop becomes large enough to break the liquid's surface tension, the liquid will not atomize as it is released from the delivery collar. Instead, a liquid conduit wig be created between the delivery collar and the ultrasound tip through which a liquid may be pulled from the delivery collar, down the ultrasound tip, towards the radiation surface.

Upon reaching the radiation surface, the liquid is atomized and propelled away from the tip by ultrasonic waves emanating from the radiation surface. Thus, ultrasonic waves traveling through the tip drive liquid delivery to the radiation surface, atomization at the radiation surface, and the ejection of atomized liquid from the tip. The spray emitted from the tip comprises small droplets of the delivered liquid, wherein the droplets are highly uniform in size throughout the resulting spray.

Once a liquid conduit has been created, the conduit will be preserved despite changes in the pressure within and/or outside the present invention. Furthermore, once the liquid conduit has been created, liquid delivery from the delivery collar to the radiation surface becomes driven by the ultrasonic waves passing through the ultrasound tip. When the delivered liquid reaches the radiation surface, the liquid is transformed into an atomized spray by the ultrasonic waves passing through the ultrasound tip and emanating from the radiation surface. Consequently, liquid delivery and atomization, once the liquid conduit has been established, is accomplished in a pressure independent manner and thus is relatively unaffected by changes in pressure within the environment into which the atomized liquid is injected. However, if the pressure within the environment into which the atomized liquid is injected becomes greater, by some factor, than the pressure forcing liquid from the delivery collar, then the liquid conduit will eventually dissipate.

Liquid flow from a delivery orifice, along the ultrasound tip, and towards the radiations surface is driven by ultrasonic waves passing through the tip. Increasing the rate at which liquid is drawn from a delivery orifice and flows towards the radiation surface can be accomplished by increasing the voltage driving the ultrasound transducer; allowing a larger volume of atomized liquid to be expelled from the tip per unit time. Conversely, decreasing the voltage driving the transducer decreases the rate of flow, reducing the volume of atomized liquid ejected from the tip per unit time. Increasing the voltage driving the ultrasound transducer also adjusts the width of the spray pattern. Consequently, increasing the driving voltage narrows the spray pattern while increasing the flow rate; delivering a larger, more focused volume of liquid. Changing the geometric conformation of the radiation surface alters the shape of the emitted spray pattern.

The system of the present invention may further comprise an injector containing an ultrasound atomizer. Use of an injector may make it easier to change and/or replace an ultrasound atomizer as to reconfigure and/or repair the system of the present invention. Incorporation of the atomizer into an injector is accomplished by coupling the liquid receiving orifices of the of an ultrasound atomizer to a channel in the injector through which liquid flows. Ideally, the entry of liquid into a channel within the injector and/or the flow of liquids through said channel are gated by some type of valve.

The atomizer may be mounted to the injector with a mounting bracket. Preferably, the mounting bracket is attached to the atomizer assembly on a nodal point of the ultrasound waves passing through the atomizer, as to minimize vibrations that may dislodge the atomizer from the injector. As to further minimize vibrations that may dislodge the atomizer from the injector, a compressible rang may be positioned distal and/or proximal to the mounting bracket. Wires supplying the driving energy to the ultrasound transducer may be threaded through a portion of the injector. The wires may terminate at a connector enabling the injector to be connected to a generator and/or power supply. The injector may also contain a-connector enabling the injector-ultrasound-atomizer assembly to be connected to a control unit and/or some other device controlling the opening and closing of valves within the injector.

When the ultrasound atomization system of the present invention is utilized to deliver gasoline into an engine, it provides several advantageous results. Finely atomizing and energizing gasoline delivered to the engine, the system of the present invention improves combustion of the gasoline while drastically reducing the amount of harmful emissions produced. Thus, gasoline delivered from the system of the present invention into an engine is almost, if not, completely and cleanly burned. Furthermore, when utilized to deliver fuel into an engine, the system of the present inventions enables the mixing of water and gasoline as to create a hybrid fuel that burns better than pure gasoline. Thus the system of the present invention, when utilized to deliver gasoline to an engine, reduces the production of harmful emissions and gasoline consumption by the engine.

The ultrasound atomization system of the present invention may further comprise at least one liquid storage area in fluid communication with the ultrasound atomizer. Pressure within the storage area may serve to deliver the liquid to be atomized to the ultrasound atomizer. Alternatively, the liquid to be atomized may be gravity feed from the storage area to the atomizer. Delivering liquid within the storage area to the atomizer may also be accomplished by incorporating a pump within the system.

The system may further comprise an electronic control unit (ECU), which may be programmable. If electronically controlled valves are included within the system, the ECU may be used to control the opening and closing of the valves. The use of such an ECU within the system enables the valves to be remotely opened and/or closed. This, in turn, enables the amount and ratio of liquid atomized and/or mixed by the system to be remotely adjusted and/or controlled during operation. This may prove advantageous when the liquid atomized and/or gasses, liquids, and/or solids (hereafter collectively referred to as material dissolved and/or suspended within the liquid atomized are reagents in a chemical reaction occurring after the material is ejected from the ultrasound tip, such as, but not limited to, combustion. Optimizing the efficiency of a chemical reaction requires maintaining a proper ratio of the reagents taking part in and/or consumed by the reaction.

Considering combustion as an example of a chemical reaction, a source of carbon such as, but not limited to, gasoline is reacted with oxygen producing heat, or energy, carbon monoxide, carbon dioxide, and water. Both the amount of oxygen and gasoline present limit the amount of heat, or energy, produced. For instance, if the amount of gasoline present exceeds the amount of oxygen present, then the amount of gasoline burned, and consequently that amount of energy produced, will be restricted by the amount of oxygen present. Thus, if the there is not enough oxygen present, then all of the gasoline ejected from the ultrasound tip will not be burned and is therefore wasted. Conversely, if the amount of oxygen present exceeds the amount of the gasoline present, then all of the gasoline will be consumed and converted into energy. Monitoring the amount of reagents consumed by the reaction, the amount of product produced by the reaction, the amount of reagent present before the reaction occurs, and/or any combination thereof can be accomplished by incorporating a material sensor capable of detecting at least one of the reagents consumed and/or products produced. Having a material sensor communicate with the ECU enables the ECU to respond to an excess of a reagent by alternating the amount of time the valves of the system are open. Reducing the amount of time valves feeding the reagent in excess are open enables the ECU to reduce the amount of the excess reagent present and/or reduce the amount of unwanted product produced. Alternatively, increasing the amount of time valves feeding the reagents not in excess remain open enables the ECU to decrease the amount of excess reagent not consumed by the reaction and/or reduce the amount of unwanted product produced. In response to an excess reagent, the ECU may also increase the rate at which the pumps within the system feed the reagents not in excess to the atomizer, thereby increasing the amount reagent delivered to and from the ultrasound tip. The ECU may also act on pumps within the system as to reduce the rate at which the reagents in excess are delivered to the atomizer.

The ECU may also communicate with pumps within the system, as to control amount of pressure generated by the pumps. Increasing or decreasing the pressure at which the liquid to be atomized are delivered to the atomizer may be advantageous if the pressure of the environment into which the atomized liquid is to be injected changes during operation. Detecting pressures changes within the environment into which the atomized liquid is injected may be accomplished by incorporating a pressure sensor within the system. Having a pressure sensor communicate with the ECU enables the ECU to respond to such pressure changes by adjusting the amount of pressure generated by the system's pumps.

One aspect of the present invention may be to provide a means producing a consistent spray of an atomized liquid in an environment, despite changes in the pressure of the environment.

Another aspect of the present invention may be to provide a means releasing a consistent spray of an atomized liquid into an environment, despite changes in the pressure of the environment.

Another aspect of the present invention may be to enable the creation of highly atomized, continuous, uniform, and/or directed spray.

Another aspect of the present invention may be to enable interrupted atomization of liquid and use of the atomized liquid to produce a coating.

Another aspect of the present invention may be to enable interrupted atomization of liquid and use of the atomized liquid to produce a coating of a controllable thickness and free from webbing and stringing.

Another aspect of the present invention may be to provide a means of mixing liquids.

Another aspect of the present invention may be to enable the mixing of two or more unmixable liquids.

Another aspect of the present invention may be to provide a means of mixing liquids as the liquids atomized as to produce a hybrid liquid spray.

Another aspect of the present invention may be to enable interrupted mixing and/or atomization of different liquids and use of the mixed liquid to produce a coating on a device of a controllable thickness and free from webbing and stringing.

Another aspect of the present invention may be to enable continuous mixing and/or atomization of different liquids and use of the mixed liquid to produce a coating on a device of a controllable thickness and free from webbing and stringing.

Another aspect of the present invention may be to enable creation of a hybrid water-gasoline fuel.

Another aspect of the present invention may be to reduce the amount of harmful emissions created from the combustion of gasoline within an engine. Another aspect of the present invention may be to enhance the combustion of gasoline injected into an engine.

Another aspect of the present invention may be to provide a means of separating liquids from material suspended and/or dissolved within the liquid.

These and other aspects of the invention will become more apparent from the written description and figures below.

BRIEF DESCRIPTION OF THE DRAWINGS

The present invention will be shown and described with reference to the drawings of preferred embodiments and dearly understood in details.

DETAILED DESCRIPTION OF THE INVENTION

Figure 1:
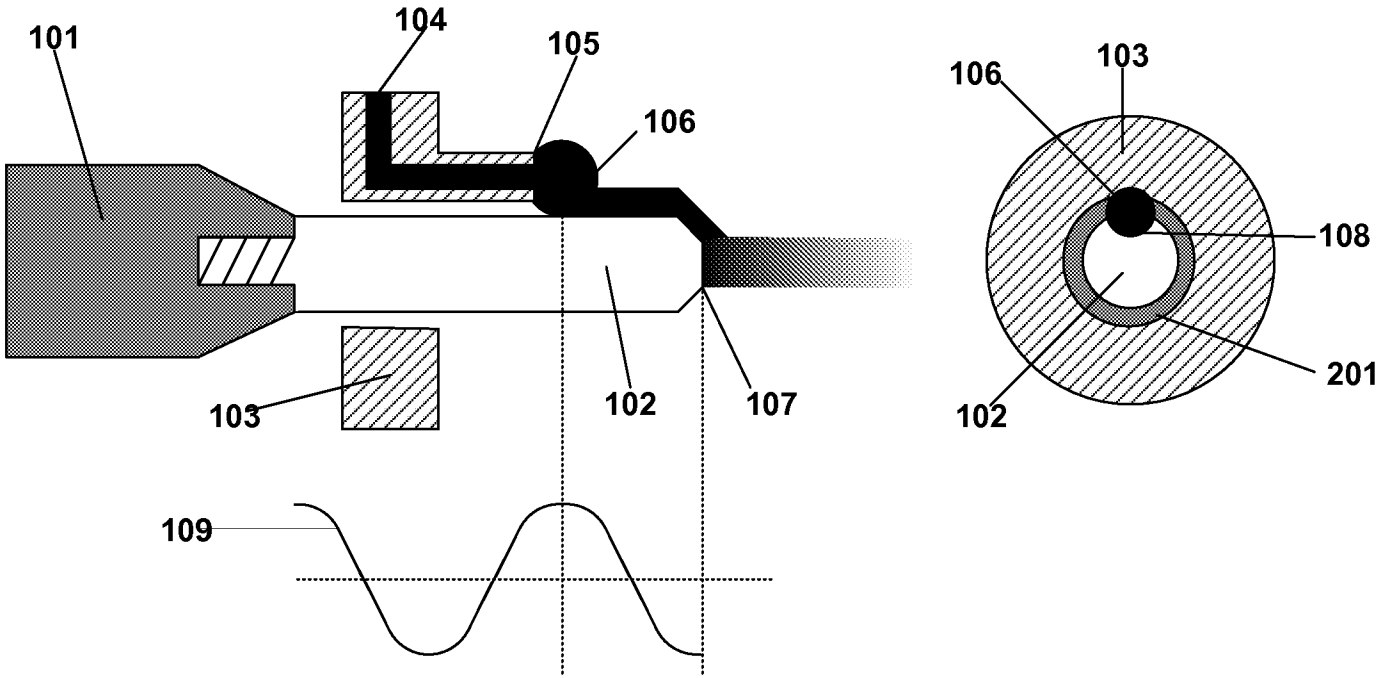
FIG. 1 depicts cross-sectional views of one embodiment of an ultrasound atomizer that may be utilized in the atomization system of the present invention.

Depicted in FIG. 1 are cross-sectional views of one embodiment of an ultrasound atomizer that may be utilized in the atomization system of the present invention. The ultrasound atomizer comprises an ultrasound transducer 101, an ultrasound tip 102 distal to said transducer 101, and a delivery collar 103 encircling said tip 102. Tip 102 may be mechanically attached, adhesively attached, and/or welded to transducer 101. Other means of attaching tip 102 to transducer 101 and preventing tip 102 from separating from transducer 101 during operation of the present invention may be equally as effective. Delivery collar 103 comprises liquid receiving orifice 104 and liquid delivery orifice 105. A pressurized liquid enters delivery collar 103 through liquid receiving orifice 104 and is expelled from delivery collar 103 through liquid delivery orifice 105. As the liquid exits liquid delivery orifice 105, the liquid forms expanding drop 106. Before drop 106 expands to a size sufficient to break the surface tension of the liquid on the surface of drop 106, drop 106 contacts ultrasound tip 102, preferably at an antinode of the ultrasound wave 109 passing through tip 102. Upon contacting ultrasound tip 102, ultrasonic waves passing through tip 102 carry the liquid within drop 106 away from drop 106 and towards radiation surface 107, thereby preventing, or at least reducing, the further expansion of drop 106. Upon reaching radiation surface 107, the liquid is atomized and propelled away from tip 102 as a highly atomized spray composed of highly uniform droplets by the ultrasonic waves emanating from radiation surface 107.

In keeping with FIG. 1, the length of tip 102 should by sufficiently short as to prevent the liquid to be atomized from falling off tip 102 before it reaches radiation surface 107. The distance the liquid to be atomized will travel along tip 102 before falling off is dependent upon the conformation of tip 102, the volume of liquid traveling along tip 102, the orientation of the atomizer, and the attraction between the liquid and tip 102. The proper length of tip 102 can be experimentally determined in the following manner. Ultrasonic waves are passed through a rod composed of the material intended to be used in the construction of tip 102 and conforming to the intended geometric shape and width of the tip to be utilized. The liquid to be atomized is then applied to the rod at a point close to the rods radiation surface. The point at which the liquid is applied to the rod is successively moved towards the proximal end of the rod until the liquid begins to fall off the rod. The distance between the radiation surface of the rod and the point just before the point at which the liquid applied to the rod fell off the rod before reaching the rod's radiation surface is the maximum length of tip 102 with respect to the liquid and volume of liquid tested. If the orientation of the tip 102 is expected to change during operation of the present invention, the above procedure should be repeated with the rod at several orientations and the shortest distance obtained should be used.

Facilitating the retention of the liquid to be atomized to tip 102 as the liquid travels down tip 102 towards radiation surface 107 can be accomplished by placing groove 108 in tip 102. Although groove 108 is depicted as a semicircular grove in FIG. 1, other configurations of groove 108 such as, but not limited, triangular, rectangular, polygonal, oblong, and/or any combination thereof may be equally as effective.

The distance between liquid delivery orifice 105 and ultrasound tip 102 and/or the bottom of groove 108 should be such that drop 106 contacts tip 102 and/or the bottom of grove 108 before drop 108 expands to a size sufficient to break the surface tension of liquid within drop 106. The distance between liquid delivery orifice 105 and tip 102 and/or the bottom of groove 108 is dependent upon the surface tension of the liquid to be atomized and the conformation of liquid delivery orifice 105. However, the distance between liquid delivery orifice 105 and tip 102 and/or the bottom of groove 108 can be experimentally determined in the following manner. Ultrasonic waves are passed through a rod conforming to the intended geometric shape and width of the tip to be utilized. An orifice conforming to the intended conformation of the delivery orifice to be utilized is then placed in close proximity to the rod. The liquid to be atomized is then forced through the orifice with the maximum liquid delivery pressure expected to be utilized. Ideally, the test should be performed within an environment with a pressures bracketing the pressure of the environment in which the system is expected to operate. The orifice is then moved away from the rod until the liquid being ejected from the orifice begins to atomize. The maximum distance between the rod and/or the bottom of any groove within the rod and the delivery orifice will be the point just before the point liquid ejected from the orifice began to atomize. If the orientation of the tip 102 is expected to change during operation of the present invention, the above procedure should be repeated with the rod at several orientations and the shortest distance obtained should be used. If the liquid ejected from the orifice atomize when the orifice is located at the closest possible point to the rod and/or the bottom of any groove within the rod, then the voltage driving the transducer generating the ultrasonic waves traveling through the rod should be increased, the pressure forcing the liquid through the orifice should be decreased, and/or the pressure within the environment increased, and the experiment repeated.

Figure 2:
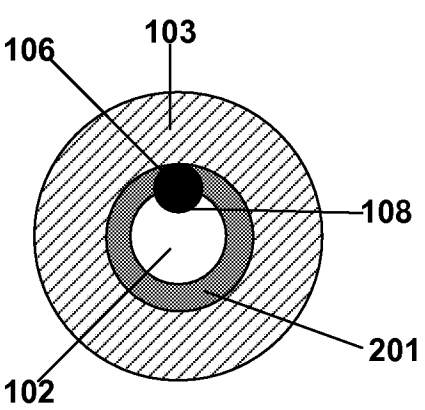
FIG. 2 depicts cross-sectional views of an alternative embodiment of an ultrasound atomizer that may be utilized in the atomization system of the present invention.
Figure 2:
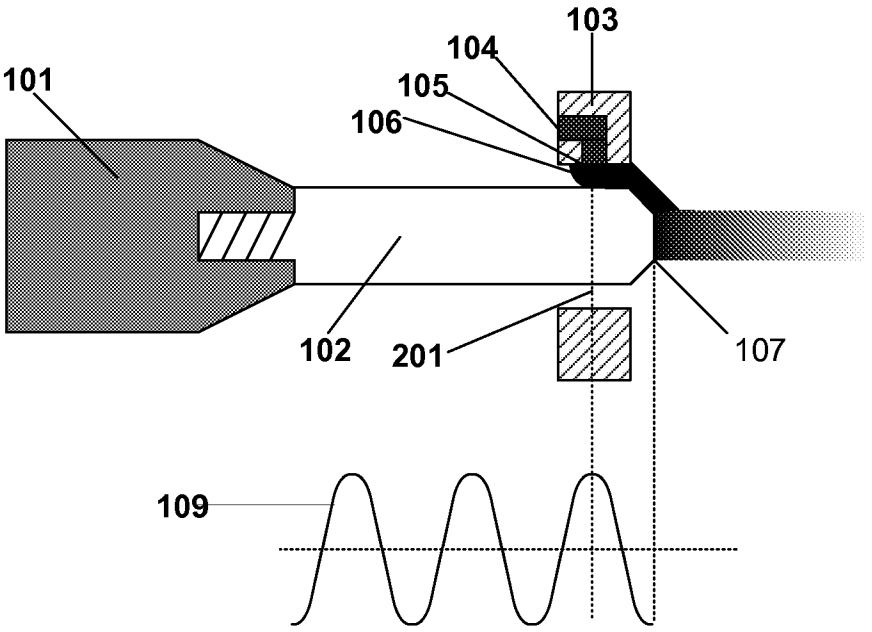

Depicted in FIG. 2 are cross-sectional views of an alternative embodiment of an ultrasound atomizer that may be utilized in the atomization system of the present invention. Delivery collar 103 comprises a central orifice 201 through which ultrasound tip 102 may be inserted and a liquid delivery orifice 105 opening within central orifice 201. A pressurized liquid enters delivery collar 103 through liquid receiving orifice 104 and is expelled from delivery collar 103 through liquid delivery orifice 105. As the liquid exits liquid delivery orifice 105 the liquid forms expanding drop 106. Before drop 106 expands to a size sufficient to break the surface tension of the liquid on the surface of drop 106, drop 106 contacts ultrasound tip 102, preferably at an antinode of the ultrasound wave 109 passing through tip 102. Upon contacting ultrasound tip 102, ultrasonic waves passing through tip 102 carry liquid within drop 108 away from drop 106 and towards radiation surface 107, thereby preventing, or at least reducing, the further expansion of drop 108. Upon reaching radiation surface 107, the liquid is atomized and propelled away from tip 102 as a highly atomized spray comprised of highly uniform droplets by the ultrasonic waves emanating from radiation surface 107. The distance between delivery orifice 105 and distal end of tip 102 can be determined by utilizing the above mentioned procedure for determining the length of tip 102.

Figure 3:
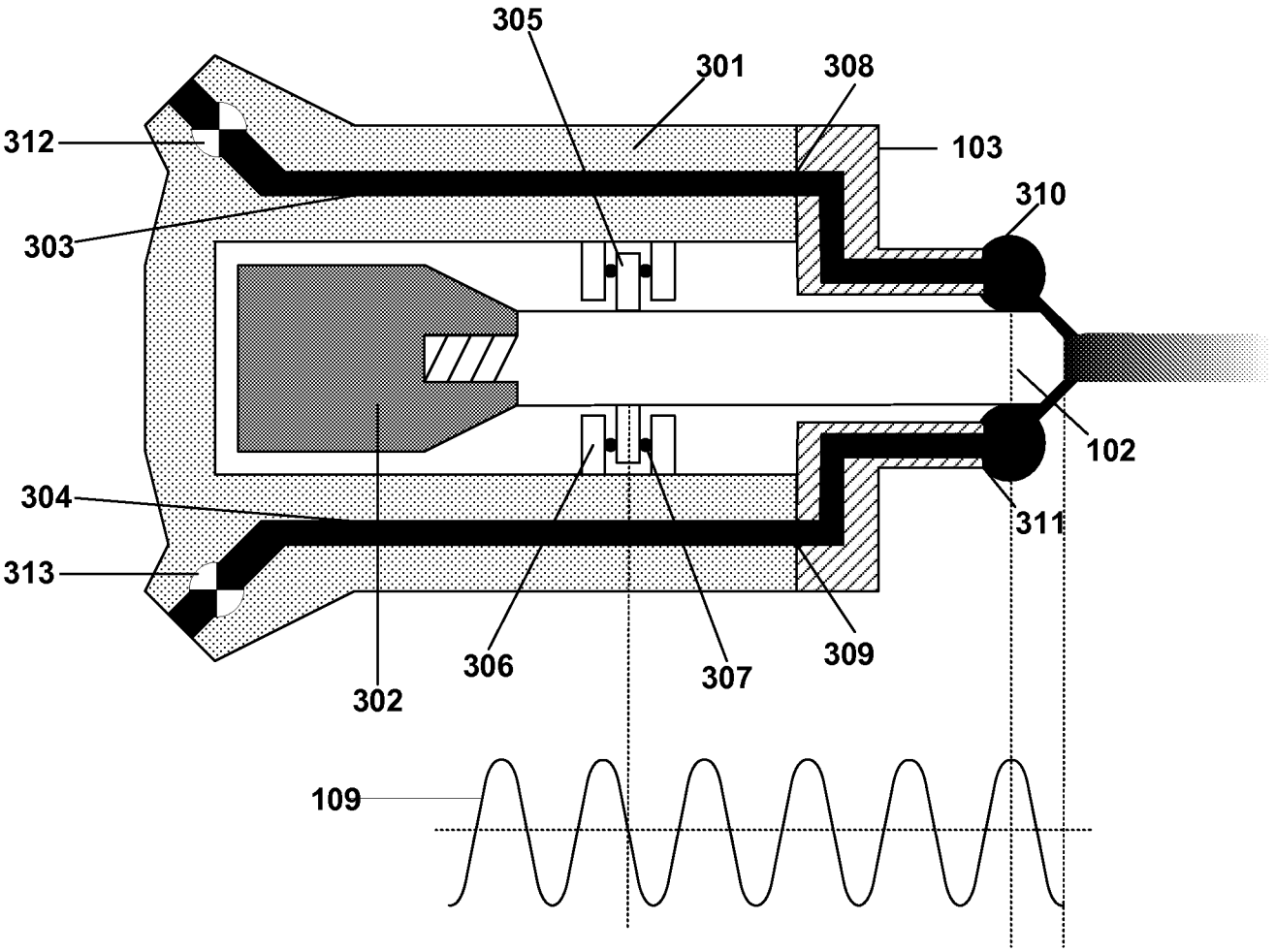
FIG. 3 depicts a cross-sectional view of a possible embodiment of an injector that may be used with the present invention.
Figure 4:
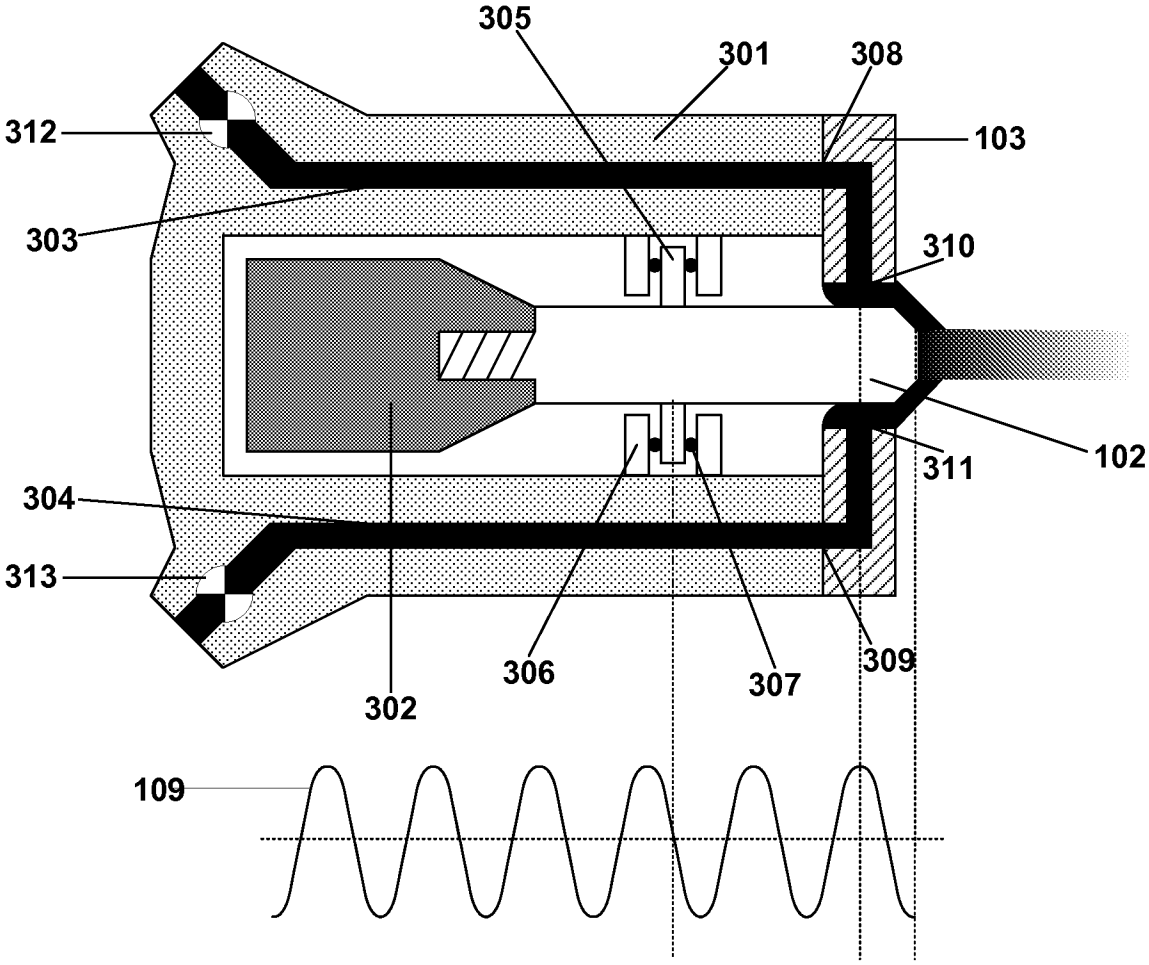
FIG. 4 depicts a cross-sectional view of a possible embodiment of an injector that may be used with the present invention.

FIGS. 3 and 4 depict cross sectional views of alternative embodiments of injectors that may be used with the present invention. The injectors comprise a body 301 encompassing ultrasound atomizer 302 and channels 303 and 304 running through body 301. Mounting bracket 305, affixed to ultrasound atomizer 302, and retainers 306, affixed to body 301, hold ultrasound atomizer 302 within the injector. Compressible O-rings 307 allow for back-and-forth movement of ultrasound atomizer 302 while reducing the strain on retainers 306. As to further minimize the strain of such movement on retainers 306, it is preferable that brackets 305 lie on nodes of the ultrasound waves 109 passing through ultrasound atomizer 302. Delivery collar 103 comprises liquid receiving orifices 308 and 309 that receive liquids from channels 303 and 304, respectively. The liquids received by orifices 308 and 309 are delivered to tip 102 through delivery orifices 310 and 311, respectively. The delivery collar 103 may be mechanically attached, adhesively attached, magnetically attached, and/or welded to body 301. Mechanically attaching delivery collar 103 to body 301 as to make delivery collar 103 readily removable enables the replacement of delivery collar 103, thereby allowing the injector to be reconfigured as to accommodate the atomization of different liquids. The valves depicted as elements 312 and 313 control the flow of liquid through channels 303 and 304, respectively, and may be electronically controlled solenoid valves. Other types of mechanically and/or electrically controlled valves may be utilized within injector, and are readily recognizable by those skilled in the art.

Figure 5:
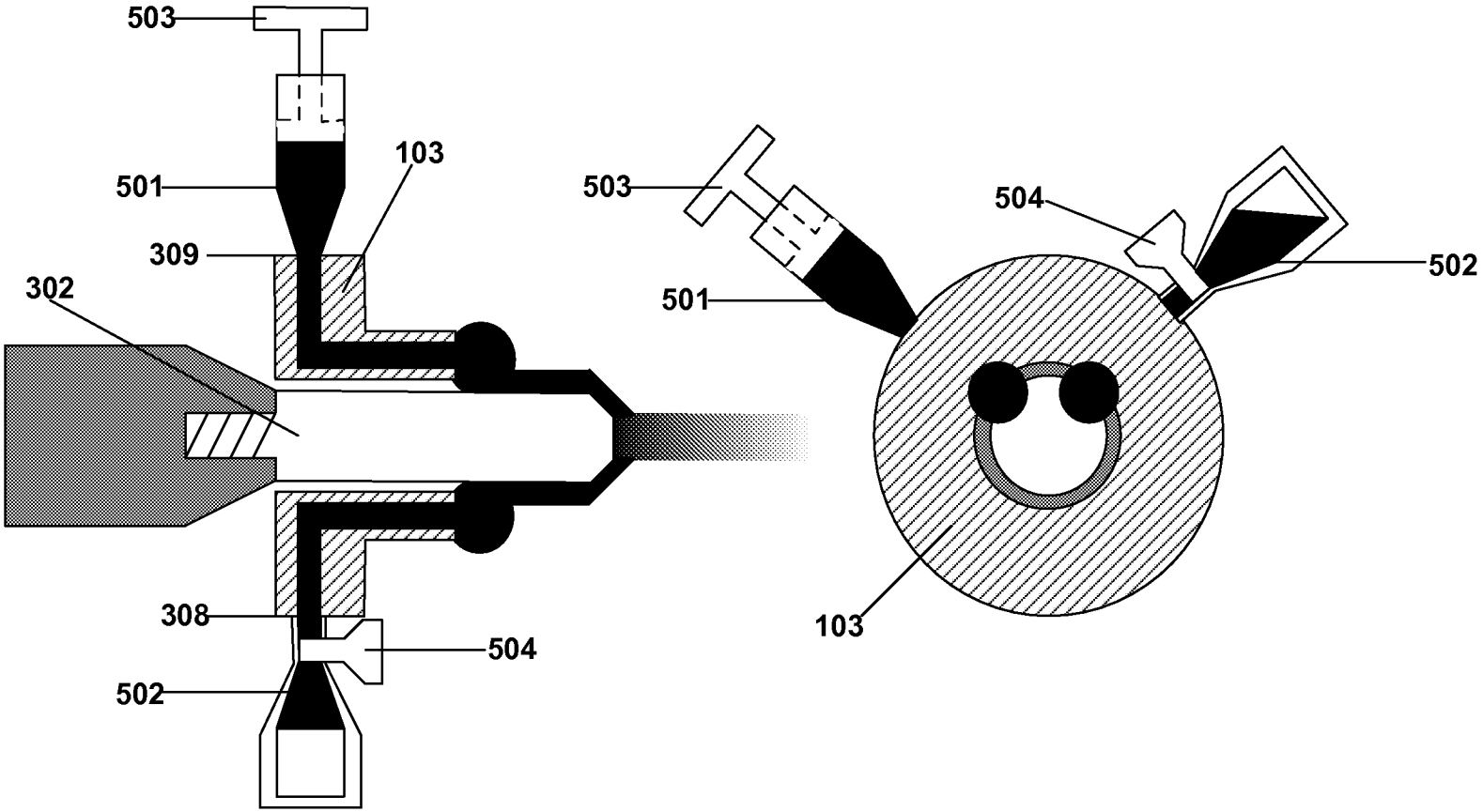
FIG. 5 illustrates a cross-sectional view of a possible embodiment of the ultrasound liquid atomization and/or separation system of the present invention.
Figure 6:
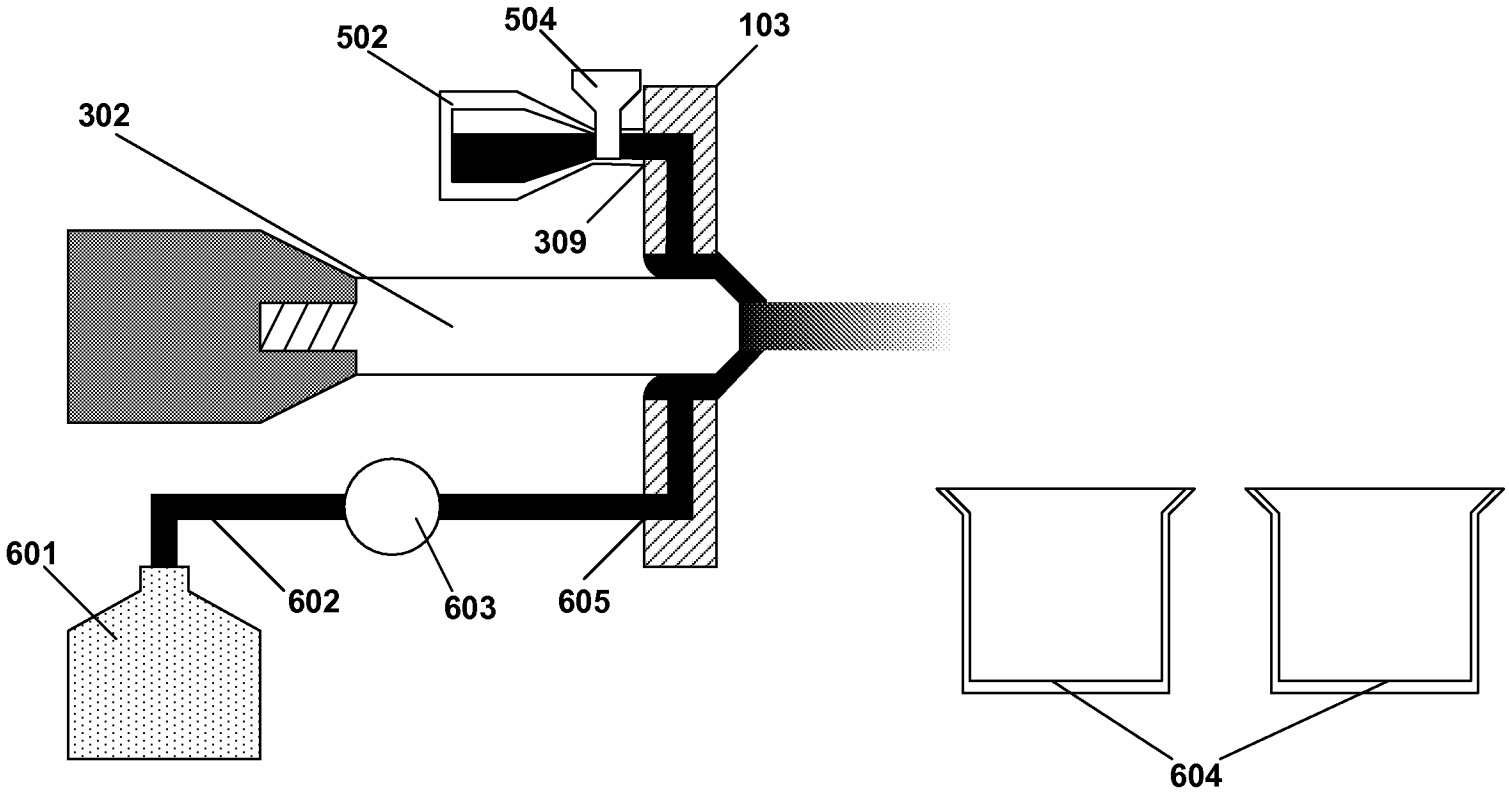
FIG. 6 illustrates a cross-sectional view of an alternative embodiment of the ultrasound liquid atomization and/or separation system of the present invention.

FIGS. 5 and 6 illustrate cross-sectional views of alternative embodiments of the ultrasound liquid atomization and/or separation system of the present invention. The ultrasound liquid atomization and/or separation system of the present invention comprises at least one liquid storage area 501, 502 and/or 601 and an ultrasound atomizer 302 in fluid communication with said storage areas 501, 502, and/or 601. Storage area 601 depicted in FIG. 6 is in fluid communication with delivery collar 103 of the ultrasound atomizer 302 by way of hose 602, connected to liquid receiving orifice 605. Pump 603 located within hose 602 facilitates the delivery of liquid from storage area 601 to delivery collar 103. Storage area 501 is in fluid communication with delivery collar 103 by way of liquid receiving orifice 308. The depression of plunger 503 delivers liquid from storage area 501 into delivery collar 103 by way of liquid receiving orifice 308. Storage area 502 is in fluid communication with ultrasound atomizer 302 by way of liquid receiving orifice 309. Opening valve 504 causes liquid held within store 502 to be gravity fed into ring orifice 309. Other types of storage areas and manners of delivering liquids to ultrasound atomizer 302, besides those depicted in FIG. 5 and/or FIG. 6 may be equally effective and will be readily recognizable by those skilled in the art. FIG. 5 and/or FIG. 6 are by no means meant to limit the different embodiments of liquid storage areas and manners of delivering liquid to ultrasound atomizer 302 that may be used with the present invention.

Focusing on FIG. 6, the ultrasound atomization and/or separation system of the present invention may further comprise collection devices 604 spaced at varying distances from ultrasound atomization unit 302. The ultrasound atomization and/or separation system of the present invention may separate liquids from material suspended and/or dissolved within the liquid. By way of example, the present invention may be utilized to separate plasma from blood. Plasma is the liquid portion of blood and may be utilized to produce several therapeutic products. As the liquid containing the suspended and/or dissolved material comes in contact with radiations surfaces within the present invention, ultrasonic waves emanating from the radiation surfaces atomize the liquid and/or push both the liquid and the material suspended and/or dissolved within the liquid away from the ultrasound tips. The distance away from the tips the liquid and suspended and/or dissolved material travel before landing depends upon the mass of the liquid droplets and suspended and/or dissolved material. The ultrasonic waves emanating from the radiation surfaces impart the same amount energy on both the liquid droplets and the suspended and/or dissolved material. However, the velocity at which the liquid droplets and suspended and/or dissolved material leave the radiation surfaces is dependent upon the mass of the liquid droplets and suspended and/or dissolved material present. The less massive a droplet or suspended and/or dissolved material, the higher the velocity at which the droplet or material leaves the ultrasound tips. The relationship between mass and departing velocity can be represented by the following equation:

$$\text{Departing Velocity} = \frac{\text{Square Root of: (Energy of Emitted Ultrasonic Wave)}}{\text{(Mass of Droplet or Material)}}$$

Generally, the droplets of the liquid will be less massive than the material suspended and/or dissolved within the liquid. Consequently, the liquid droplets will generally have a higher departing velocity than the suspended and/or dissolved material. However, both the liquid droplets and the suspended and/or dissolved material will fall-towards the ground or the floor of the device at the same rate. The distance the droplets or suspended and/or dissolved material travel before hitting the ground increases as the velocity at which the droplets or suspended and/or dissolved material leave the radiation surfaces increases. Therefore, the less massive droplets will travel farther than more massive suspended and/or dissolved material real falling to the ground. Thus, the liquid and material suspended and/or dissolved within the liquid may be separated based on the distance away from the ultrasound tips each travels. In addition to separating material on the basis of mass, the present invention may also be utilized to separate material on the basis of boiling point. For instance, if the liquid atomized contains several liquids mixed together, the present invention may be used to separate the liquids. The liquid mixture is first atomized with the ultrasound atomizer of the present invention and injected into an environment with a temperature above the boiling point of at least one of the liquids. For example, assume that the liquid contains ethanol and water and the removal of the water from the ethanol is desired. The liquid containing the mixture of water and ethanol could be injected into an environment with a temperature at or above 78.4° C., the boiling point of ethanol, and below 100° C., the boiling point of water. Atomized into a spray of small droplets, the liquid will quickly approach the temperature of the environment. When the temperature of the liquid reaches the boiling point of ethanol, the ethanol will evaporate out of the small droplets. The droplets may then be collected in a container. The evaporated ethanol may be collected as a gas and/or allowed to condense and collected as a liquid.

The ultrasound atomization and/or separation system of the present invention may also be utilized to combine liquids. If different liquids are delivered to the ultrasound tip, they will combine at the radiation as the liquids are atomized.

Figure 7:
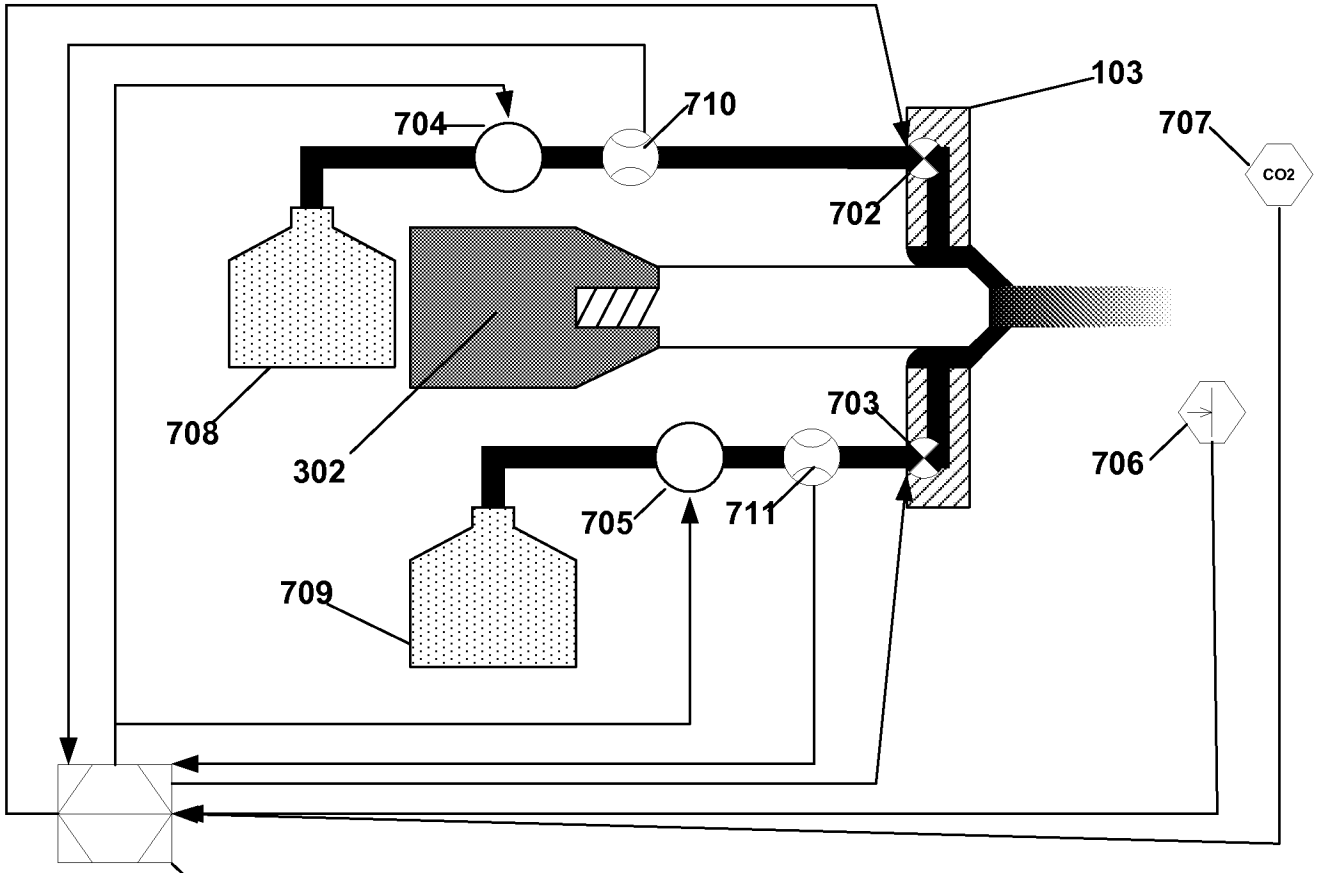
FIG. 7 depicts a schematic of an alternative embodiment of the ultrasound atomization and/or separation system of the present invention further comprising an electronic control unit.

FIG. 7 depicts a schematic of an alternative embodiment of the ultrasound atomization and/or separation system of the present invention further comprising an ECU 701, electronically controlled valves 702 and 703, pumps 704 and 705, pressure sensor 706, and material sensor 707. ECU 701 communicates with valves 702 and 703 as to remotely open and close said valves, thereby controlling when and how much liquid is delivered from storage areas 708 and 709, respectively, to the delivery collar 103 of ultrasound atomizer 302. The amount of liquid delivered from storage areas 708 and 709 to ultrasound atomizer 302 may be monitored and communicated to ECU 701 by flow rate sensors 710 and 711, respectively. This may prove advantageous when the amount and/or ratio of liquid atomized and/or mixed needs to be maintained and/or varied during operation of the system. Monitoring the amount of liquid released from atomizer 302 and/or material present after a chemical reaction taking place following said release, sensor 707 communicates to ECU 701 the amount of material released, consumed, and/or produced. The information provided by sensor 707 enables ECU 701 to respond to excesses in the amount of any material released, consumed, and/or produced by closing and/or opening valves 702 and/or 703. Reducing the amount of time valves 702 and/or 703 remain open, ECU 701 reduces the amount of the excess liquid delivered from storage area 708 and/or 709; respectively. Alternatively, increasing the amount of time valves 702 and/or 703 remain open, ECU 701 increases the amount of needed liquid delivered from storage area 708 and/or 709, respectively. In response to an excess material, ECU 701 may also increase the rate at which the pumps 704 and/or 705 feed liquid to ultrasound atomizer 302, thereby increasing the amount of the needed material released from atom zero 302. ECU 701 may also reduce the rate at which pumps 704 and/or 705 feed a liquid in excess to ultrasound atomizer 302.

In keeping with FIG. 7, ECU 701 may also communicate with pumps 704 and/or 705, as to control the amount of pressure generated by said pumps. Increasing and/or decreasing the pressure at which the liquid to be atomized and/or mixed is delivered to ultrasound atomizer 302 may be advantageous if the pressure of the environment into which the atomized and/or mixed liquid is to be injected changes during operation of the system. Having pressure sensor 706 communicate with ECU 701 enables ECU 701 to respond to such pressure changes by adjusting the amount of pressure generated by pumps 704 and/or 705.

Figure 8:
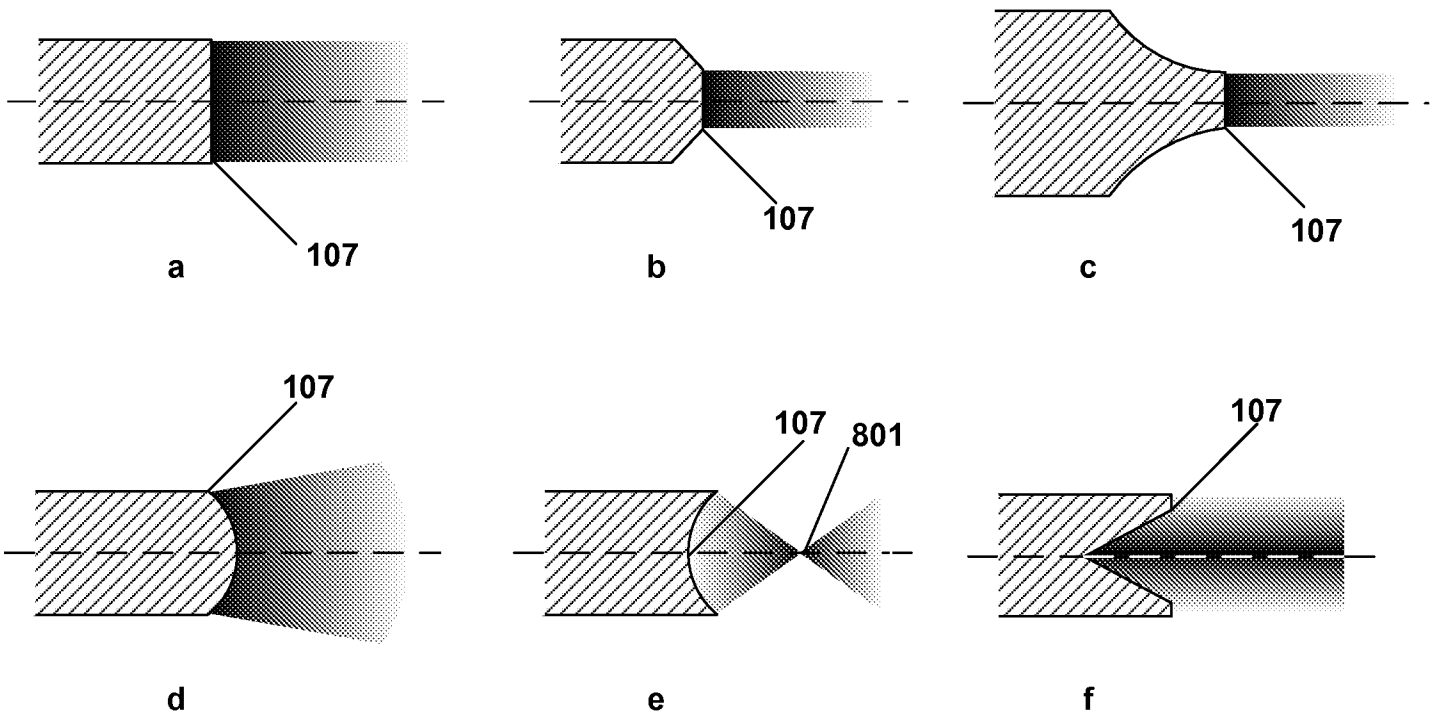
FIG. 8 illustrates alternative embodiments of the radiation surface of the ultrasound tip that may be used with the present invention.

FIG. 8 illustrates alternative embodiments of radiation surface 107 that may be used with the present invention. FIGS. 8*a*, and 8*b*, and 8*c* depict radiation surfaces 107 comprising a flat face and producing a roughly column like spray pattern. Radiation surface 107 may also be tapered, as depicted in FIGS. 8*b* and 8*c*. Ultrasonic waves emanating from the radiation surfaces 107 depicted in FIGS. 8*a, b*, and *c* direct and confine the vast majority of the atomized spray to the outer boundaries of the radiation surfaces 107 flat faces. Consequently, the majority of the spray in FIGS. 8*a*, 8*b*, and 8*c*, is initially confined to the geometric boundaries of radiation surfaces 107. The ultrasonic waves emitted from the convex radiation surface 107 depicted in FIG. 8*d* directs the spray radially and longitudinally away from radiation surface 107. Conversely, the ultrasonic waves emanating from the concave radiation surface 107 depicted in FIG. 8*e* focuses the spray through focal point 801. The radiation surface 107 may also possess a conical configuration as depicted in FIG. 8*f*. Ultrasonic waves emanating from the slanted portions of radiation surface 107 depicted in FIG. 8*f* direct the atomized spray inwards. The radiation surface of the ultrasound tip may possess any combination of the above mentioned configurations such as, but not limited to, an outer concave portion encircling an inner convex portions and/or an outer planer portion encompassing an inner conical portion.

As to facilitate production of the spray patterns depicted in FIG. 8*a-f*, it is preferable if the ultrasound tip of the present invention is vibrated in resonance. If the spray exceeds the geometric bounds of the radiation, i.e. is fanning to wide, when the tip is vibrated in resonance, increasing the voltage driving the ultrasound transducer may narrow the spray. Conversely, if the spray is too narrow, then decreasing the voltage driving the transducer may widen the spray.

Ultrasonic waves passing through the tip of the ultrasound atomizer may have a frequency of approximately 16 kHz or greater and an amplitude of approximately 1 micron or greater. It is preferred that the ultrasonic waves passing through the tip of the ultrasound atomizer have frequency between approximately 20 kHz and approximately 200 kHz. It is recommended that the frequency of the ultrasonic waves passing through the tip of the ultrasound atomizing/mixing unit be approximately 30 kHz.

The signal driving the ultrasound transducer may be a sinusoidal wave, square wave, triangular wave, trapezoidal wave, or any combination thereof.

Although specific embodiments have been illustrated and described herein, it will be appreciated by those of ordinary skill in the art that any arrangement that is calculated to achieve the same or similar purpose may be substituted for the specific embodiments. It is to be understood that the above description is intended to be illustrative and not restrictive. Combinations of the above embodiments and other embodiments will be apparent to those having skill in the art upon review of the present disclosure. The scope of the present invention should be determined with reference to the appended claims, along with the full scope of equivalents to which such claims are entitled.

The method of action of the present invention and prior art devices presented herein are based solely on theory. They are not intended to limit the method of action of the present invention or exclude of possible methods of action that may be present within the present invention and/or responsible for the actions of the present invention.

I claim:

1. An ultrasound atomizer comprising:

a. an ultrasound transducer;

b. an ultrasound tip having a radial surface between a distal end and a proximal end;

c. a radiation surface at the ultrasound tip distal end;

d. the ultrasound tip proximal end fastened to the ultrasound transducer;

e. a delivery collar having a delivery collar distal end, a liquid receiving orifice and a liquid delivery orifice in fluid communication with the liquid receiving orifice and sufficiently narrow to atomize an exiting pressurized liquid;

f. the liquid delivery orifice positioned at a distance from the tip such that said pressurized liquid exiting the liquid delivery orifice as an expanding drop contacts the ultrasound tip before the surface tension of the liquid is broken by the expansion of the drop to permit forming from the drop a liquid conduit between the delivery collar and the ultrasound tip.

2. The ultrasound atomizer of claim 1 having a groove within the radial surface.

3. The ultrasound atomizer of claim 1 wherein the liquid delivery orifice is positioned to deliver the drop near the antinode position of an ultrasound wave passing through the tip.

4. The ultrasound atomizer of claim 1 wherein the delivery collar encircles the ultrasound tip.

5. The ultrasound atomizer of claim 1 wherein delivery collar does not contact the ultrasound tip.

6. The ultrasound atomizer of claim 1 further comprising a convex portion within the radiation surface.

7. The ultrasound atomizer of claim 1 further comprising a concave portion within the radiation surface.

8. The ultrasound atomizer of claim 1 further comprising a flat portion within the radiation surface.

9. The ultrasound atomizer of claim 1 further comprising a tapered portion within the radiation surface.

10. The ultrasound atomizer of claim 1 further comprising a conical portion within the radiation surface.

* * * * *